US006937826B2

(12) United States Patent
Yamamoto et al.

(10) Patent No.: US 6,937,826 B2
(45) Date of Patent: Aug. 30, 2005

(54) IMAGE FORMING APPARATUS AND PROGRAM FOR CONTROLLING IMAGE FORMING APPARATUS

(75) Inventors: Satoru Yamamoto, Ibaraki (JP); Mitsuhiko Sato, Chiba (JP); Hideyuki Ikegami, Chiba (JP); Kuniyasu Kimura, Ibaraki (JP)

(73) Assignee: Canon Kabushiki Kaisha (JP)

( * ) Notice: Subject to any disclaimer, the term of this patent is extended or adjusted under 35 U.S.C. 154(b) by 16 days.

(21) Appl. No.: 10/673,918

(22) Filed: Sep. 29, 2003

(65) Prior Publication Data

US 2004/0136738 A1 Jul. 15, 2004

(30) Foreign Application Priority Data

Sep. 30, 2002 (JP) ..... 2002-287178

(51) Int. Cl.[7] ..... G03G 15/00
(52) U.S. Cl. ..... 399/49; 399/46
(58) Field of Search ..... 399/46, 49, 50, 399/51, 55, 72, 301, 302

(56) References Cited

U.S. PATENT DOCUMENTS 6,336,008 B1 * 1/2002 Nakazato et al. ..... 399/49

FOREIGN PATENT DOCUMENTS

JP 2001-134043 A 5/2001

* cited by examiner

*Primary Examiner*—Hoang Ngo
(74) *Attorney, Agent, or Firm*—Rossi, Kimms & McDowell, LLP

(57) ABSTRACT

There is provided an image forming apparatus which is capable of securing a time period for measuring the base reflected light quantity required for the base correction, and at the same time, reducing a time period required for the entire image density control. An image forming unit includes an image carrier disposed to be exposed to light to have a latent image formed thereon, an electrostatic charger that charges the image carrier to a predetermined polarity, a developing device that visualizes the latent image formed on the image carrier to form a visible image, and an endless belt onto which the visible image is transferred. A CPU controls the image forming unit to form predetermined detection patterns on the endless belt. The detection patterns and the quantity of reflection light from the endless belt are detected. The CPU corrects the detected detection patterns based on the detected quantity of reflection light. One of the image forming conditions is adjusted by the CPU, based on the corrected detection result of the detection patterns. Another one of the image forming conditions is adjusted by the CPU. The detection of the quantity of reflection light from the endless belt is carried out in timing synchronous with the adjustment of the other image forming condition.

16 Claims, 11 Drawing Sheets

IMAGE FORMING APPARATUS AND PROGRAM FOR CONTROLLING IMAGE FORMING APPARATUS

BACKGROUND OF THE INVENTION

1. Field of the Invention

The present invention relates to an image forming apparatus, such as a copying machine, a printer, and a facsimile, which forms an image using electrophotography, and a program for controlling an image forming apparatus of this type.

2. Description of the Related Art

In an image forming apparatus of the electrophotographic type, the image density varies depending on temperature and humidity conditions of an environment under which the apparatus is used, as well as on the degree of usage of process stations (specifically, developing sections and electrostatic charging sections used for forming an image). The image forming apparatus carries out image density control to correct for such variations of the image density. For example, the image density control is carried out as follows. Density patches in respective colors are formed on photosensitive members, or an intermediate transfer belt (hereinafter referred to as the "ITB") or an electrostatic (absorption) transfer belt (hereinafter referred to as the "ETB"), and then the density patches are read by density detecting sensors. The results of reading are fed back to different types of high voltage conditions and process forming conditions including laser power, thereby adjusting the maximum densities and halftone gradation characteristics of the respective colors to uniform levels. It should be noted that image density control that maintains the maximum densities of the respective colors constant is referred to as Dmax control, and image density control that maintains the halftone gradation characteristics linear with respect to an image signal obtained by reading an image on an original is referred to as D half control. The Dmax control serves to maintain the color balance between the respective colors constant, and further, the Dmax control also has such an important role as preventing scatter of a character formed by overlapped colors caused by excessive toner deposition and faulty fixing.

In general, the density detecting sensor illuminates a density patch using a light source, and detects the intensity of reflected light with a light receiving sensor. A signal representing the intensity of reflected light is subjected to analog-to-digital conversion and the analog-to-digital converted signal is subjected to predetermined processing by a CPU, and the signal after the predetermined processing is fed back to the process forming conditions. Specifically, in the Dmax control, a plurality of density patches formed under respective different image forming conditions are detected by optical sensors, a conditions which enable the desired maximum density to be obtained are calculated from the detected results, and the image forming conditions are changed based on the calculated conditions.

The density detecting sensor is roughly divided into two types, i.e. a type of detecting diffuse reflection (irregular reflection) components of the reflected light and a type of detecting specular reflection (regular reflection) components of the reflected light. First, a detailed description will now be given of the method of detecting the diffuse reflection components. The diffuse reflection components are components of reflection that are sensed as a color, and have such a characteristic that the quantity of the reflected light increases as the quantity of colorant, namely the quantity of a toner, of the density patch increases.

FIG. 12 is a graph showing the relationship between the quantity of the diffuse reflected light and the quantity of the toner, which is applicable to a conventional image forming apparatus. The reflected light also has such a characteristic that the light is diffused uniformly in all directions from the density patch. The type of the density detecting sensor for detecting diffuse reflection components is configured such that the illumination angle and the angle of incidence are different from each other to eliminate the influence of the specular reflection components, described later.

However, when the density detecting sensor for detecting diffuse reflection components is used to detect the density of a black toner, the black toner absorbs light, and therefore the sensor cannot detect light reflected from the black toner. Therefore, in this case, a method has been proposed in which a base in a chromatic color is used as the base of the density patch, and the density of the black toner is detected by measuring a quantity of reflected light from parts of the base other than those blocked by the black toner, for example.

When an image forming apparatus of an inline type which includes a plurality of photosensitive members is used, to reduce the number of the density sensors, it can be thought that a density patch is formed on an ETB or an ITB, and a single density sensor is used to detect the densities of the all colors, instead of forming and detecting density patches on the photosensitive members. In this case, it is necessary to adjust resistance generated between a sheet and the ETB or ITB to secure a sheet conveying force and image stability on the ITB, and therefore carbon black is scattered over the ETB or ITB. Consequently, the ETB or ITB often comes to present a black or dark gray color. Therefore, when the density of the black toner on the ETB or ITB is detected, light is not reflected from either the density patch or the base, and the type of the density sensor which detects the diffuse reflection light cannot detect the black toner. Thus, it is necessary to use the type of the density sensor for detecting the specular reflected light as described later.

FIG. 13 is a diagram showing the relationship between the quantity of the specular reflected light and the quantity of the toner. A detailed description will now be given of the method of detecting specular reflection components of the reflected light. The sensor of the type that detects specular reflected light is disposed to detect light reflected in a direction symmetrical with the illumination angle with respect to a normal line to the base surface (the ETB or ITB surface). The quantity of the reflected light depends on the refractivity specific to the material of the base (namely the ETB or ITB) and the reflectivity determined by the surface condition of the base, and is sensed as gloss. When a density patch is formed on the base, a part of the base on which the toner is deposited blocks light and does not generate reflected light. Consequently, the quantity of the toner on the density patch and the quantity of the specular reflected light presents such a relationship that the reflected light quantity decreases as the toner quantity increases as shown in FIG. 13.

The density sensor of the type that detects specular reflected light is disposed to mainly detect not the reflected light from the toner, but the reflected light from the base, and therefore the sensor can detect the density of the density patch regardless of the colors of the toner and the base, and thus, is more advantageous in density detection than the density sensor of the type that detects diffuse reflected light. In addition, the quantity of the reflected light of the specular reflection components is generally larger than the quantity of the reflected light of the diffuse reflection components, and thus, the density sensor of the type that detects specular reflected light is advantageous also in the detection accuracy of the density sensor, and therefore, it is also desirable to use the density sensor of the type that detects specular reflected light when the density is detected on the photosensitive member.

However, there arises a problem when density sensor of the type that detects specular reflected light is used to detect a toner in a chromatic color. As described above, when light is irradiated on a density patch of a chromatic color toner, the diffuse reflected light increases as the toner quantity increases, and the reflected light scatters uniformly in all the directions. Thus, the light detected by the density sensor is the sum of the specular reflection components and the diffuse reflection components.

FIG. 14 shows the relationship between the toner quantity and the reflected light quantity when a chromatic color toner is detected by the density sensor of the type that detects specular reflected light. Namely the relationship between the toner quantity and the reflected light quantity is the sum of a thin solid line curve which represents the characteristic of the specular reflection, and a broken line curve which represents the characteristic of the diffuse reflection, and presents a negative characteristic shown as a thick solid line curve. Thus, to exhibit both the characteristics of the specular reflected light and the diffuse reflected light, there has been generally employed such a method in which radiated light from a single light emitting element 301 is detected by an optical sensor as shown in FIG. 3, which is comprised of two light receiving elements 302 and 303 for receiving specular reflected light and for diffuse reflected light, respectively, thereby detecting the density.

When the density sensor of the type mainly detecting reflected light from the base is used, if the surface state of the base changes with the use of the base, the reflected light quantity changes accordingly. Thus, it is effective for the density detection to apply correction such as normalizing the reflected light quantity of the density patch with the reflected light quantity of the base, and then, converting the normalized quantity into density information (hereinafter referred to as "base correction"). In this case, it is desirable that measurement of the reflected light quantity of the base for the base correction should be carried out in the same timing as the formation of the density patch and at the same part of the base on which the density patch is formed in consideration of material variation and aging change of the ETB or ITB. Thus, as a method of measuring the quantity of the light reflected by the base, there has been employed such a method as alternately measuring the density of the density patches and the quantity of the light reflected by the base as shown in FIG. 15, or successively measuring the density of the density patches and then measuring the quantity of the light reflected by the base for one turn of the ITB or the ETB as shown in FIG. 16.

However, when the base reflected light quantity is measured simultaneously with measuring the density patch in image density control, there is such a problem that the entire measurement takes time. For example, with the method shown in FIG. 15, if the measurement interval for the density patches and the measurement interval for the base reflected light quantity are the same, the entire measurement requires twice of the time period required in the case where only the density patches are measured. Also, with the method shown in FIG. 16, a time period for rotating the ITB or the ETB by one turn is additionally required compared with the case where only the density patches are measured.

SUMMARY OF THE INVENTION

It is an object of the present invention to provide an image forming apparatus and a program for controlling the image forming apparatus which are capable of securing a time period for measuring the base reflected light quantity required for the base correction, and at the same time, reducing a time period required for the entire image density control.

To attain the above object, in a first aspect of the present invention, there is provided an image forming apparatus comprising an image forming unit including an image carrier disposed to be exposed to light to have a latent image formed thereon, an electrostatic charger that charges the image carrier to a predetermined polarity, a developing device that visualizes the latent image formed on the image carrier to form a visible image, and an endless belt onto which the visible image is transferred, a plurality of image adjusting devices that adjust image forming conditions of the image forming unit, the image adjusting devices including a first image adjusting device and a second image adjusting device, a detection pattern forming device that controls the image forming unit to form predetermined detection patterns on the endless belt, a detecting device that detects the detection patterns formed on the endless belt and a quantity of reflection light from the endless belt, and a correction device that corrects the detection patterns detected by the detecting device based on the quantity of reflection light from the endless belt detected by the detecting device, wherein the first image adjusting device adjusts one of the image forming conditions of the image forming unit based on the corrected detection result of the detection patterns, the second image adjusting device adjusts another one of the image forming conditions of the image forming unit, and the detecting device detects the quantity of reflection light from the endless belt in timing synchronous with the adjustment of the other one of the image forming conditions by the second image adjusting device.

According to the first aspect of the present invention, the detecting device detects the quantity of reflection light from the endless belt in timing synchronous with the adjustment of the other one of the image forming conditions by the second image adjusting device. Therefore, it is not necessary to separately detect the quantity of reflection light from the endless belt following detection of the detection patterns formed on the endless belt, which makes it possible to reduce the downtime of the image forming apparatus as much as possible, and at the same time, carry out optimum image control (especially image density control). As a result, it is possible to secure a time period for measuring the base reflected light quantity required for the base correction, and at the same time, reduce a time period required for the entire image density control.

Preferably, the detecting device detects density patches formed on the endless belt as the predetermined detection patterns, and the first image adjusting device adjusts the one of the image forming conditions of the image forming unit based on the detected density patches, to adjust density of an image to be formed.

More preferably, the first image adjusting device carries out one of image density control that maintains respective maximum densities of a plurality of predetermined colors constant and image density control that maintains gradation characteristics of halftone linear with respect to an image signal obtained by reading an image on an original.

Preferably, the second image adjusting device comprises a device that rotates the endless belt, and a device that forms images on the endless belt at locations other than locations at which the predetermined detection patterns are formed.

More preferably, the second image adjusting device comprises an image writing position adjusting device that adjusts a writing position for an image.

To attain the above object, in a second aspect of the present invention, there is provided an image forming apparatus comprising an image forming unit including an image carrier disposed to be exposed to light to have a latent image formed thereon, an electrostatic charger that charges the image carrier to a predetermined polarity, a developing device that visualizes the latent image formed on the image carrier to form a visible image, and an endless belt onto which the visible image is transferred, a detection pattern forming device that controls the image forming unit to form predetermined detection patterns on the endless belt, a detecting device that detects the detection patterns formed on the endless belt and a quantity of reflection light from the endless belt, a correction device that corrects the detection patterns detected by the detecting device based on the quantity of reflection light from the endless belt detected by the detecting device, and an image adjusting device that adjusts at least one image forming condition of the image forming unit based on the corrected detection result of the detection patterns, wherein the detecting device detects the quantity of reflection light from the endless belt in timing different from timing in which the at least one image forming condition is adjusted by the image adjusting device.

According to the second aspect of the present invention, the detecting device detects the quantity of reflection light from the endless belt in timing different from timing in which the at least one image forming condition is adjusted by the image adjusting device. Therefore, it is not necessary to separately detect the quantity of reflection light from the endless belt following detection of the detection patterns formed on the endless belt, which makes it possible to reduce the downtime of the image forming apparatus as much as possible, and at the same time, carry out optimum image control (especially image density control). As a result, it is possible to secure a time period for measuring the base reflected light quantity required for the base correction, and at the same time, reduce a time period required for the entire image density control.

Preferably, the detecting device detects density patches formed on the endless belt as the predetermined detection patterns, and the image adjusting device adjusts the at least one image forming condition of the image forming unit based on the detected density patches, to adjust density of an image to be formed.

More preferably, the image adjusting device carries out one of image density control that maintains respective maximum densities of a plurality of predetermined colors constant and image density control that maintains gradation characteristics of halftone linear with respect to an image signal obtained by reading an image on an original.

Preferably, the timing different from the in which the other one of the image forming conditions is adjusted is timing in which the endless belt is rotating and at a same time images are formed on the endless belt at locations other than locations at which the predetermined detection patterns are formed.

Still more preferably, the endless belt is an intermediate transfer belt.

To attain the above object, in a third aspect of the present invention, there is provided a program for controlling an image forming apparatus including an image forming unit including an image carrier disposed to be exposed to light to have a latent image formed thereon, an electrostatic charger that charges the image carrier to a predetermined polarity, a developing device that visualizes the latent image formed on the image carrier to form a visible image, and an endless belt onto which the visible image is transferred, the program comprising a detection pattern forming module for controlling the image forming unit to form predetermined detection patterns on the endless belt, a first detecting module for detecting the detection patterns formed on the endless belt, a second detecting module for detecting a quantity of reflection light from the endless belt, and a correction module for correcting the detection patterns detected by the detecting module based on the quantity of reflection light from the endless belt detected by the detecting module, wherein the first image adjusting module adjusts one of the image forming conditions of the image forming unit based on the corrected detection result of the detection patterns, the second image adjusting module adjusts another one of the image forming conditions of the image forming unit, and the detecting module detects the quantity of reflection light from the endless belt in timing synchronous with the adjustment of the other one of the image forming conditions by the second image adjusting module.

To attain the above object, in a fourth aspect of the present invention, there is provided a program for controlling an image forming apparatus including an image forming unit including an image carrier disposed to be exposed to light to have a latent image formed thereon, an electrostatic charger that charges the image carrier to a predetermined polarity, a developing device that visualizes the latent image formed on the image carrier to form a visible image, and an endless belt onto which the visible image is transferred, the program comprising a detection pattern forming module for controlling the image forming unit to form predetermined detection patterns on the endless belt, a first detecting module for detecting the detection patterns formed on the endless belt, a second detecting module for detecting a quantity of reflection light from the endless belt, a correction module for correcting the detection patterns detected by the first detecting module based on the quantity of reflection light from the endless belt detected by the second detecting module, and an image adjusting module for adjusting at least one image forming condition of the image forming unit based on the corrected detection result of the detection patterns, wherein the second detecting module detects the quantity of reflection light from the endless belt in timing different from timing in which the at least one image forming condition is adjusted by the image adjusting module.

To attain the above object, in a fifth aspect of the present invention, there is provided an image forming apparatus comprising an image forming unit including an image carrier disposed to be exposed to light to have a latent image formed thereon, an electrostatic charger that charges the image carrier to a predetermined polarity, a developing device that visualizes the latent image formed on the image carrier to form a visible image, and an endless belt onto which the visible image is transferred, a detection pattern forming device that controls the image forming unit to form predetermined detection patterns on the endless belt, a detecting device that detects the detection patterns formed on the endless belt and a quantity of reflection light from the endless belt, a correction device that corrects the detection patterns detected by the detecting device based on the quantity of reflection light from the endless belt detected by the detecting device, and an image adjusting device that adjusts at least one image forming condition of the image forming unit based on the corrected detection result of the detection patterns, wherein the image adjusting device includes an image writing position adjusting device that adjusts a writing position for an image, and the detecting device detects the quantity of reflection light from the endless belt in timing different from timing in which the at least one image forming condition is adjusted by the image adjusting device, by detecting the quantity of reflection light upon turning-on of power of the image forming apparatus or in synchronism with the adjustment of the writing position for an image.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
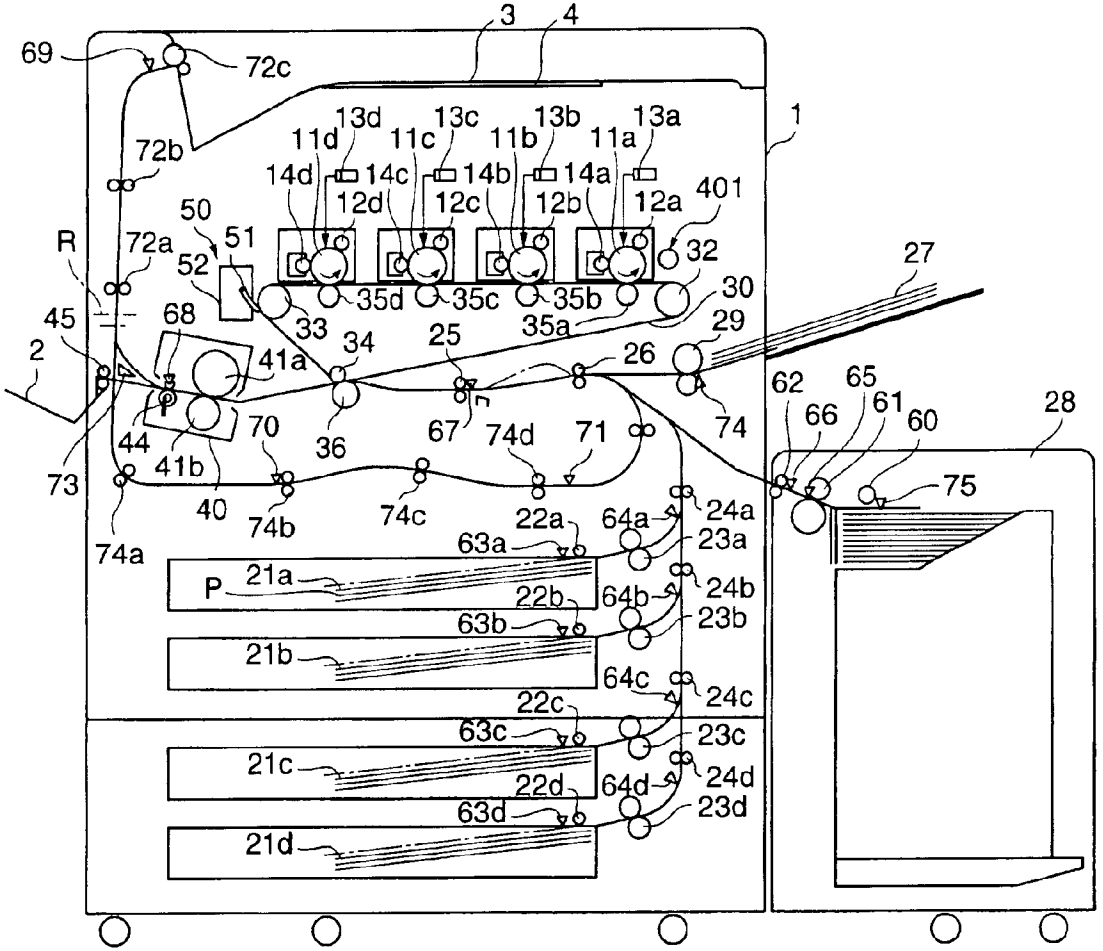
FIG. 1 is a schematic sectional view showing an image forming apparatus according to a first embodiment of the present invention.

The present invention will now be described in detail below with reference to the accompanying drawings showing preferred embodiments thereof. In the drawings, elements and parts which are identical throughout the views are designated by identical reference numeral, and duplicate description thereof is omitted.

FIG. 1 is a sectional view showing an image forming apparatus according to a first embodiment of the present invention. The image forming apparatus according to the present embodiment is an electrophotographic type. The image forming apparatus 1 is comprised of a plurality of units mainly including an image forming section (four stations a, b, c, and d, which are arranged in parallel and are identical in construction with each other), a sheet feed section, an intermediate transfer section, a conveying section, a fixing section, an operating section, and a control unit shown in FIG. 2.

A detailed description will now be given of the above-mentioned units. The image forming section is constructed as follows. Photosensitive drums 11*a,* 11*b,* 11*c,* and 11*d* as image carriers are supported at respective central shafts thereof, and are each rotatively driven by a driving motor, not shown, in a direction indicated by an arrow in FIG. 1. At locations opposed to respective outer peripheral surfaces of the photosensitive drums 11*a* to 11*d,* roller chargers 12*a,* 12*b,* 12*c,* and 12*d,* scanners 13*a,* 13*b,* 13*c,* and 13*d,* and developing devices 14*a,* 14*b,* 14*c,* and 14*d* are arranged respectively in a direction in which the photosensitive drums 11*a* to 11*d* are rotated. The roller chargers 12*a* to 12*d* apply a uniform amount of electric charge to the surface of the respective photosensitive drums 11*a* to 11*d*. Then, the scanners 13*a* to 13*d* cause the respective photosensitive drums 11*a* to 11*d* to be exposed to a ray of light such as a laser beam, which has been modulated according to a image signal obtained by reading an image on an original, so that electrostatic latent images are formed on the respective photosensitive drums 11*a* to 11*d*. Further, the developing devices 14*a* to 14*d* visualize the respective electrostatic latent images using respective stored developers (hereinafter referred to as "toners") of four colors: yellow (Y), cyan (C), magenta (M), and black (K). The visualized images are transferred onto an intermediate transfer belt (hereinafter referred to as "ITB") 30. By the above described processing, images are successively formed using respective toners of four colors.

The sheet feed section is comprised of a part where recording materials (recording sheets) P are stored, rollers for conveying the recording materials P, sensors for detecting the passage of the recording materials P, sensors for detecting the presence of the recording materials P, and guides, not shown, for conveying the recording materials P on a conveying path. In FIG. 1, reference numerals 21*a,* 21*b,* 21*c,* and 21*d* denote cassettes; 27, a manual feed tray; and 28, a deck. They store recording materials P. Reference numerals 22*a,* 22*b,* 22*c,* and 22*d* denote pick-up rollers for feeding the recording materials P sheet by sheet from the respective cassettes 21*a* to 21*d*. The pick-up rollers 22*a* to 22*d* may each feed a plurality of recording materials P simultaneously, but the plurality of recording materials P are surely separated sheet by sheet by a corresponding one of sheet feed roller pairs 23*a,* 23*b,* 23*c,* and 23*d.* The recording material P separated as a single sheet by any of the sheet feed rollers 23*a* to 23*d* is further conveyed to a registration roller pair 25 by a corresponding one of drawing roller pairs 24*a* to 24*d* and a pre-registration roller pair 26. The recording materials P stored in the manual feed tray 27 are separated sheet by sheet by a sheet feed roller pair 29, and the separated recording material P is conveyed to the registration roller pair 25 by the pre-registration roller pair 26. The recording materials P stored in the deck 28 are conveyed by a plurality of sheets to a sheet feed roller pair 61 by a pick-up roller 60, and are surely separated sheet by sheet by the sheet feed roller pair 61 and conveyed to a drawing roller pair 62. Further, the recording material P, which has been conveyed to the drawing roller pair 62, is then conveyed to the registration roller pair 25 by the pre-registration roller pair 26.

A detailed description will now be given of the intermediate transfer section. In FIG. 1, reference numeral 30 denotes an intermediate transfer belt (ITB), which is an endless belt made of PET (polyethylene terephthalate) or PVdF (polyvinylidene fluoride), for example.

The ITB 30 is supported by a driving roller 32 for transmitting a driving force to the ITB 30, a tension roller 33 for applying a proper tension to the ITB 30 by means of a spring, not shown, and a driven roller 34 for forming a secondary transfer region by sandwiching the ITB 30 between itself and a secondary transfer roller 36, referred to later. The driving roller 32 is formed of a metal roller having a surface thereof coated with rubber (urethane rubber or chloroprene rubber) of a thickness of several millimeters so as to prevent the driving roller 32 from slipping on the ITB 30. The driving roller 32 is rotatively driven by a stepping motor, not shown. Primary transfer rollers 35*a* to 35*d* to which high voltage for transferring respective toner images onto the ITB 30 is applied are arranged at locations opposed to the respective photosensitive drums 11*a* to 11*d* through the ITB 30.}

The secondary transfer roller 36 is opposed to the driven roller 34, and forms the secondary transfer region by a nip between the secondary transfer roller 36 and the ITB 30. The secondary transfer roller 36 is pressurized against the ITB 30 with an appropriate force. A cleaning device 50 for cleaning an image forming surface of the ITB 30 is disposed at a location downstream of the secondary transfer region and opposed to the tension roller 33. The cleaning device 50 is comprised of a cleaner blade 51 (made of such a material as polyurethane rubber), and a waste toner box 52 for storing waste toner. The fixing section is comprised of a fixing unit 40. The fixing unit 40 includes a fixing roller 41*a* having a heat source such as a halogen heater incorporated therein, a roller 41*b* (this roller may also have a heat source incorporated therein) pressurized by the fixing roller 41*a,* and an internal sheet discharging roller 44 for conveying the recording material P discharged from the above-mentioned pair of rollers.

When a recording material P is conveyed to the registration roller pair 25, rotative driving of the rollers upstream of the registration roller pair 25 is temporarily stopped, and rotative driving of the upstream rollers together with the registration roller pair 25 is resumed in timing synchronous with image forming timing by the image forming section. Thereafter, the recording material P is fed to the secondary transfer region. Images on the ITB 30 are transferred onto the recording material P in the secondary transfer region, then the transferred images are fixed by the fixing unit 40. The recording material P on which the images are fixed by the fixing unit 40 passes through the internal sheet discharging roller 44 and then has its conveying destination switched by a switching flapper 73. If the switching flapper 73 is in a face-up sheet discharging position, the recording material P is discharged to a face-up sheet discharge tray 2 by an external sheet discharging roller pair 45. On the other hand, if the switching flapper 73 is in a face-down sheet discharging position, the recording material P is conveyed to inversion roller pairs 72*a,* 72*b,* and 72*c* and then discharged to a face-down sheet discharge tray 3. In the case where images are formed on both sides of the recording material P, the recording material P is conveyed toward the face-down sheet discharge tray 3, and when the trailing end of the recording material P reaches an inverting location R, the conveyance of the recording material P is temporarily stopped, and the rotational direction of the inversion roller pairs 72*a,* 72*b,* and 72*c* is reversed to convey the recording material P to double-sided sheet roller pairs 74*a* to 74*d.* Then, the recording material P is conveyed again to the image forming section as in the case where the recording material P is conveyed from any one of the cassettes 21*a* to 21*d.* It should be noted a plurality of sensors are arranged on the conveying path for the recording material P, for detecting the passage of the recording material P. These sensors include sheet feed retry sensors 64*a,* 64*b,* 64*c,* and 64*d,* a deck sheet feed sensor 65, a deck drawing sensor 66, a registration sensor 67, an internal discharged sheet sensor 68, a face-down discharged sheet sensor 69, a double-sided pre-registration sensor 70, and a double-sided sheet refeed sensor 71. Further, cassette sheet detecting sensors 63*a,* 63*b,* 63*c,* and 63*d* for detecting the presence of recording materials P are arranged in the respective cassettes 21*a* to 21*d* that store recording materials P, a manual feed tray sheet detecting sensor 76 for detecting the presence of a recording material P on the manual feed tray 27 is disposed in the manual feed tray 27, and a deck sheet detecting sensor 75 for detecting the presence of a recording material P in the deck 28 is disposed in the deck 28.

The operating section 4 is disposed on an upper surface of the image forming apparatus 1, and enables selection of any sheet feed section in which the recording material P is stored (the sheet feed cassettes 21*a* to 21*d,* the manual feed tray 27, or the deck 28), selection of any sheet discharge tray (the face-up sheet discharge tray 2 or the face-down sheet discharge tray 3), designation of a tab sheet bundle, and so forth.

Figure 2:
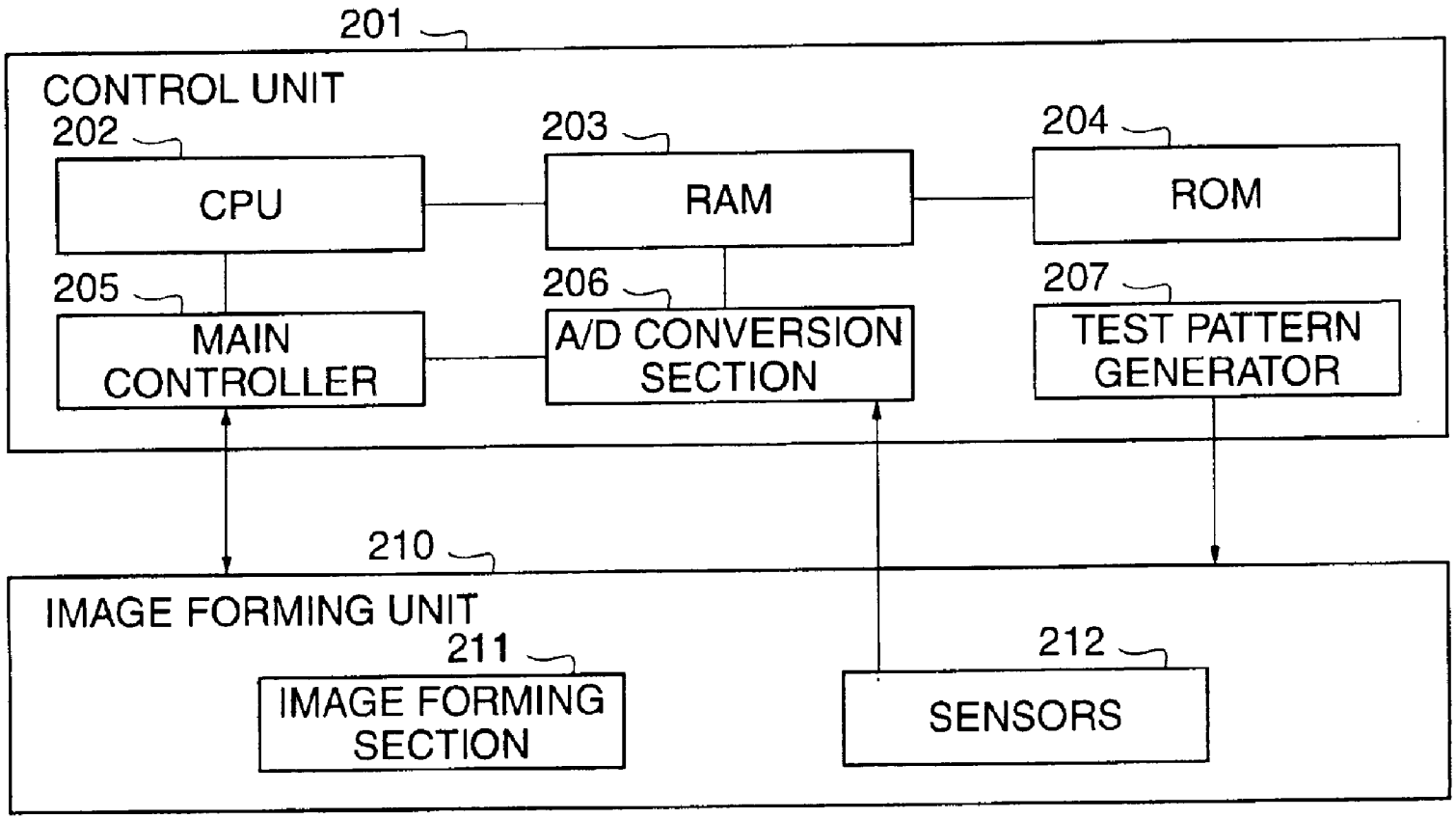
FIG. 2 is a block diagram showing the relationship between a control unit for controlling processing by the image forming apparatus in FIG. 1, and an image forming unit including an image forming section, a sheet feed section, an intermediate transfer section, a conveying section, and a fixing section.

FIG. 2 is a diagram showing the relationship between the control unit for controlling processes by the image forming apparatus in FIG. 1, and the image forming unit including the image forming section, the sheet feed section, the intermediate transfer unit, the conveying section, and the fixing unit of the image forming apparatus described above.

The control unit 201 is comprised of a CPU 202, a RAM 203 for storing temporary data, a ROM 204 that stores software for operating the image forming apparatus, and fixed data, a main controller 205 for controlling the operation of the entire image forming apparatus, an A/D conversion device 206 for converting analog data from sensors in the image forming apparatus into digital data, and a test pattern generator 207 for generating test patterns such as density patches. The image forming unit 210 is comprised of a image forming section 211 including the above-mentioned image forming section (i.e., four stations a, b, c, and d, which are arranged in parallel and are identical in construction with each other), the sheet feed section, the intermediate transfer section, the conveying section, and the fixing section, and various sensors 212 for monitoring states of the respective component sections or devices of the image forming section 211. The image forming unit 210 forms an image according to image data transmitted from the control unit 201 or a test pattern such as a density patch according to an instruction from the main controller 205. Further, the detected states from the sensors 212 are transmitted from the image forming unit 210 to the control unit 201 at any time or as the need arises.

A description will now be given of the operation of the image forming apparatus constructed as above. For example, a description is given of a case where an image is formed on the recording material P conveyed from the cassette 21*a*. When a predetermined period of time has passed after an image formation start signal is transmitted from the control unit 201 to the image forming unit 210, the pick-up roller 22*a* feeds out the transfer materials P sheet by sheet from the cassette 21*a*. Then, each recording material P is conveyed by the sheet feed roller pair 23*a* to the registration roller pair 25 via the drawing roller pair 24*a* and the pre-registration roller pair 26. On this occasion, the registration roller pair 25 is stopped, and the leading end of the sheet comes to abut on the nip of the registration roller pair 25. Then, the registration roller pair 25 starts rotating in timing corresponding to the start timing of the image formation by the image forming section. This rotation start timing is set such that the recording material P and the toner images primarily transferred onto the ITB 30 by the image forming section exactly align with each other in the secondary transfer region.

On the other hand, when the above-mentioned image formation start signal is issued, the toner image formed on the photosensitive drum 11*d* located at an upstream end in the rotational direction of the ITB 30 is primarily transferred onto the ITB 30 in a primary transfer region by the primary transfer roller 35*d* with high voltage applied thereto in the process described above. The toner image primarily transferred onto the ITB 30 is conveyed to the next primary transfer region. In the next primary transfer region, image formation is carried out in timing delayed by a period of time in which the toner image is conveyed from one image forming section to the next image forming section so that the next toner image is transferred onto the ITB 30 such that the leading end of the next toner image is aligned with the leading end of the previous image. Thereafter, the same processing is repeated, and finally, four-color toner images are primarily transferred onto the ITB 30. Then, when the recording material P enters the secondary transfer region and comes into contact with the ITB 30, high voltage is applied to the secondary transfer roller 36 in timing with passage of the recording material P through the secondary transfer roller 36. Then, the four-color toner images formed on the ITB 30 by the above described processing are transferred onto the surface of the recording material P. The recording material P is then guided to a nip between the fixing roller 41*a* and the pressurizing roller 41*b* of the fixing unit 40. The toner images are fixed on the surface of the recording material P by heat generated by the fixing roller 41*a* and the pressurizing roller 41*b* and pressure generated by the nip. Then, the recording material P is selectively discharged to the face-up sheet discharge tray 2 or to the face-down sheet discharge tray 3 depending on the direction switched by the switching flapper 73.

In the present embodiment, a resin film made of PVdF having a peripheral length of 896 mm and a thickness of 100 μm is used as the ITB 30 shown in FIG. 1.

Figure 3:
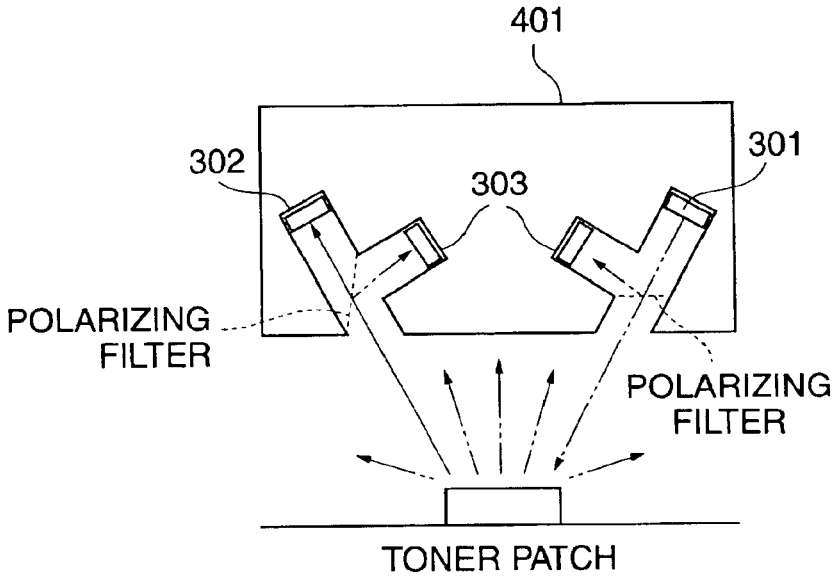
FIG. 3 is a view showing the construction of an optical sensor installed in the image forming apparatus according to the present embodiment.
Figure 4:
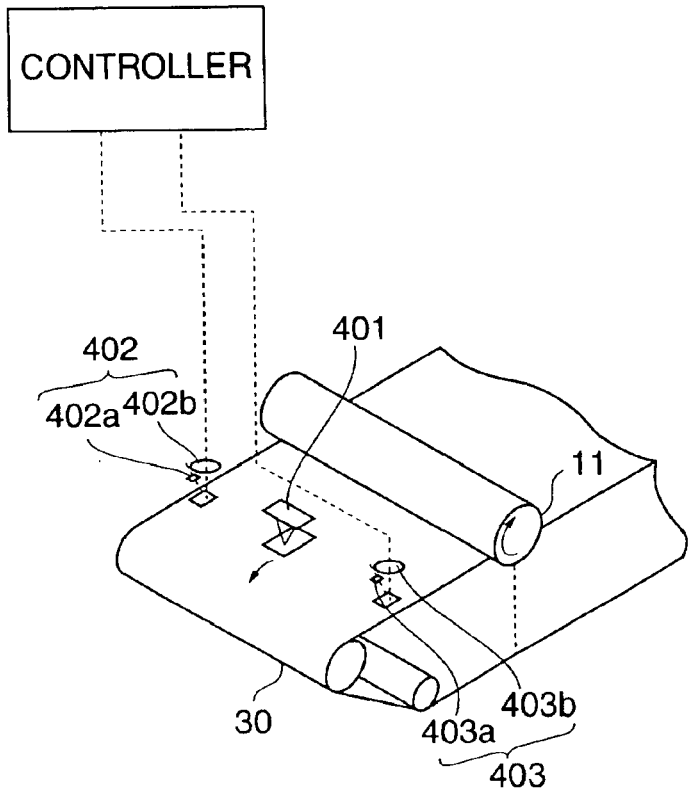
FIG. 4 is a view showing the arrangement of the optical sensor in the image forming apparatus according to the present embodiment.

FIG. 3 is a view showing the construction of an optical sensor installed in the image forming apparatus according to the present embodiment. FIG. 4 is a view showing the arrangement of the optical sensor in the image forming apparatus according to the present embodiment.

The optical sensor 401 is installed at the center in the depth-wise direction of the ITB 30 in the present embodiment. The optical sensor 401 is comprised of a light emitting element 301 such as an LED, and light receiving elements 302, 303 such as photodiodes. The light receiving elements are comprised of an element Vop 302 for receiving specular reflected light, and elements Vos 303 for receiving diffuse reflected light. The light receiving element Vop 302 is disposed at such a location that it detects a ray of reflected light which is reflected by the ITB 30 at the same angle as a ray of radiated light from the light emitting element 301, among rays of radiated light from the light emitting element 301. The light receiving elements Vos 303 are disposed at such locations that they detect rays of reflected light which are diffusely reflected by the density patch on the ITB 30 and then pass through polarizing filters, among rays of radiated light from the light emitting element 301.

Figure 5:
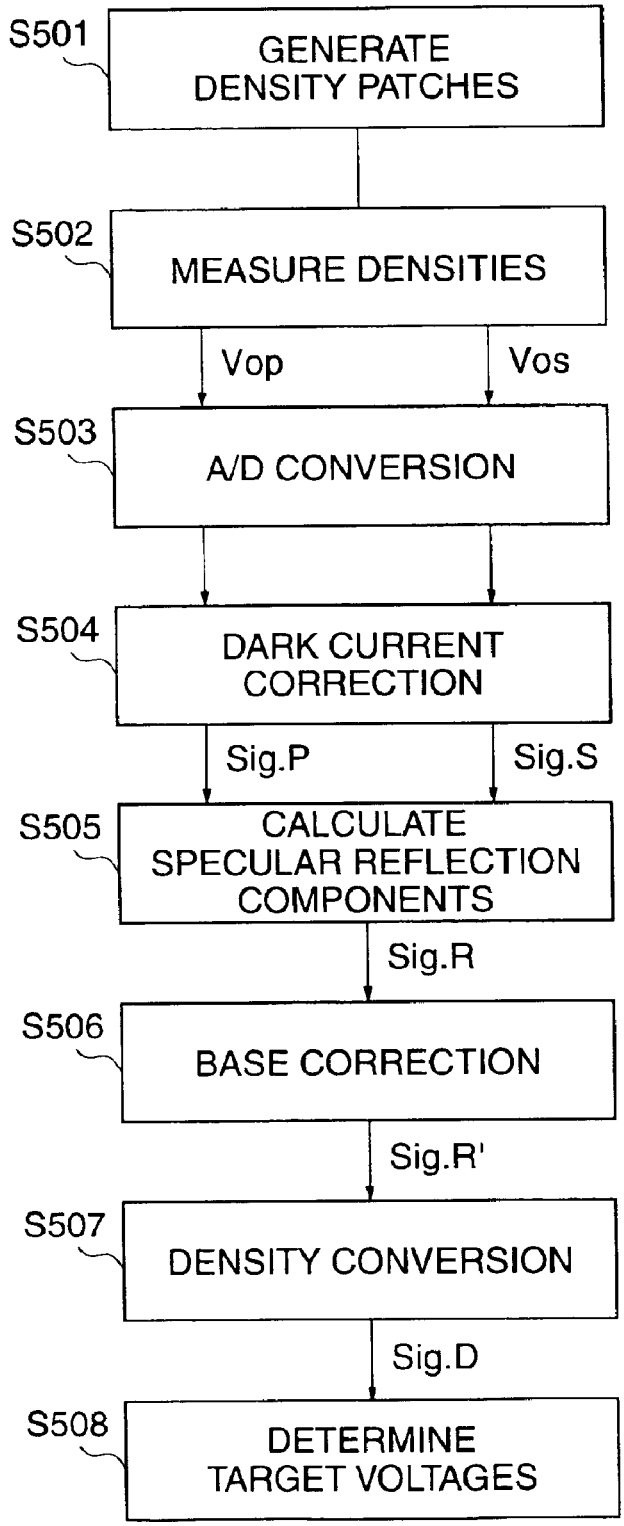
FIG. 5 is a flowchart showing Dmax control carried out to adjust the maximum density of an image to a predetermined density.

A detailed description will now be given of Dmax control which is carried out as an example of the image density control according to the present invention. FIG. 5 is a flowchart showing Dmax control carried out to adjust the maximum density of an image to a predetermined density.

In the present embodiment, the Dmax control is executed once whenever image formation is carried out 500 times.

First, in a step S501, the CPU 202 in FIG. 2 transmits image data of a patch generated by the test pattern generator 207 to the scanner 13*d*. The scanner 13*d* exposes to light the photosensitive drum 11*d*, which is charged at a charging bias VpY1, described later, to form a latent image of a density patch PY1 on the photosensitive drum 11*d*. This latent image is developed by the developing device 14*d* at a development bias VdY1, described later.

Figure 6:
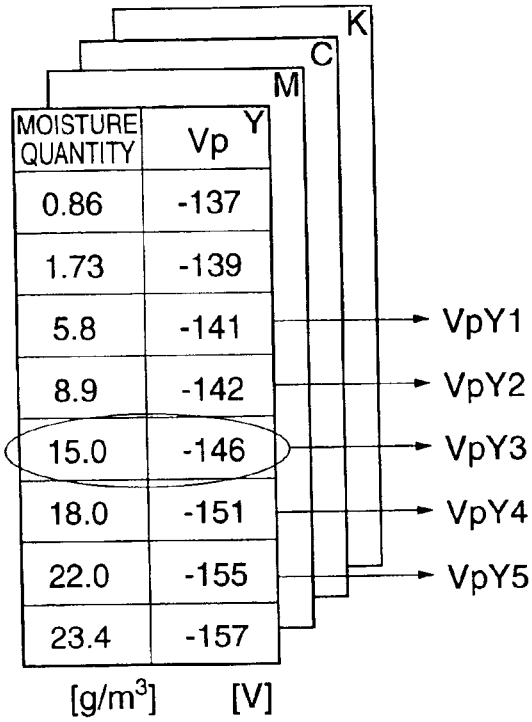
FIG. 6 is a diagram showing a table of the relationship between a moisture quantity [g/cm$^3$] in the air detected by a moisture sensor disposed in the image forming apparatus, and a charging bias Vp.
Figure 7:
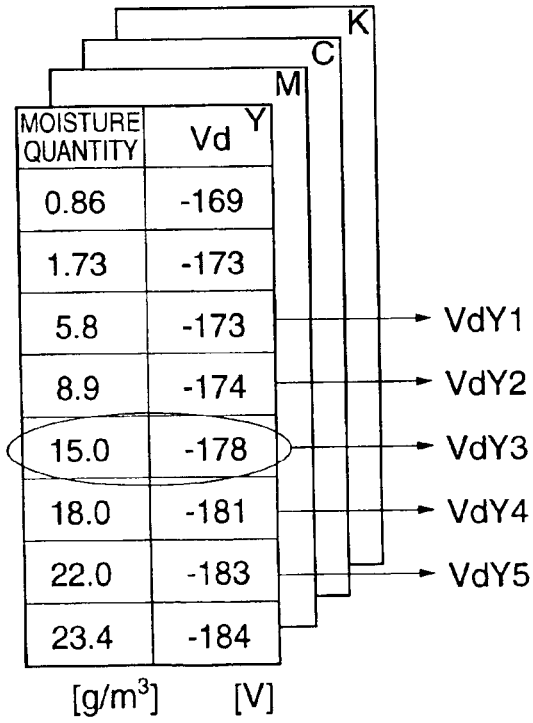
FIG. 7 is a diagram showing a table of the relationship between a moisture quantity [g/cm$^3$] in the air detected by a moisture sensor disposed in the image forming apparatus, and, and a development bias Vd.

It should be noted that the charging bias Vp and the development bias Vd are determined by tables shown in FIGS. 6 and 7 stored in the ROM 204 of the image forming apparatus.

FIG. 6 shows a table of the relationship between a moisture quantity [g/cm$^3$] in the air detected by a moisture sensor disposed in the image forming apparatus, and the charging bias Vp. Four types of this table are provided, which correspond to the respective colors of the photosensitive drums: yellow, magenta, cyan, and black. For example, it is assumed that if the present moisture quantity obtained from the moisture sensor is 15.0 g/m3, the charging bias for yellow corresponding to this moisture quantity is designated as VpY3. Then, VpY2 and VpY1 are obtained in the decreasing direction of the moisture quantity with respect to VpY3 using the table for yellow. Conversely, VpY4 and VpY5 are obtained in the increasing direction of the moisture quantity with respect to VpY3 using the table for yellow. In this way, charging biases VpYn (n=1–5) for yellow to be used for the Dmax control are obtained. In the same manner, VpMn, VpCn, and VpKn (n=1–5) are obtained respectively for magenta, cyan, and black.

FIG. 7 showing a table of the relationship between a moisture quantity [g/cm$^3$] in the air detected by the moisture sensor disposed in the image forming apparatus, and the development bias Vd. Development biases VdYn, VdMn, VdCn, and VdKn (n=1–5) to be used for the Dmax control are obtained respectively for yellow, magenta, cyan, and black from this table in a similar manner to the manner of obtaining the charging biases.

The density patch PY1 formed on the photosensitive drum 11*d* in this way is transferred onto the ITB 30 by applying a transfer bias from the power source to the transfer roller 35*d*. Then, following the density patch for yellow, density patches are formed respectively for magenta, cyan, and black in similar manners, to form density patches PY1, PM1, PC1, and PK1 respectively for yellow, magenta, cyan, and black on the ITB 30 in a manner being arranged in a line in the main scanning direction.

Figure 8:
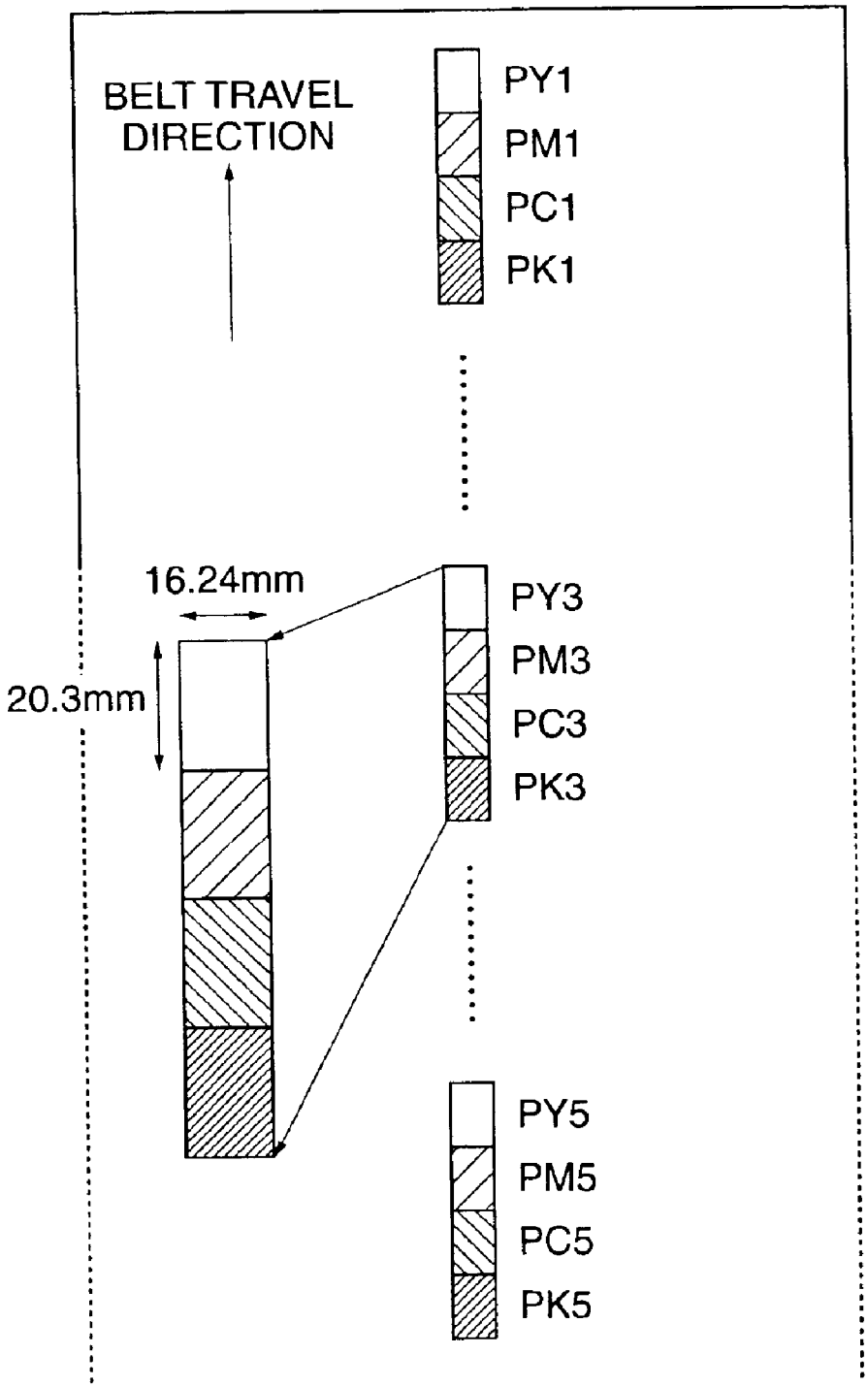
FIG. 8 is a view showing the size of density patches.

FIG. 8 is a view showing the size of density patches. In the present embodiment, the size of the individual density patches is set to 20.3 mm in the main scanning direction, and 16.24 mm in the sub scanning direction as shown in FIG. 8. Then, the charging bias is changed from VpY1 to VpY2, and the development bias is changed from VdY1 to VdY2, to form a density patch PY2 for yellow on the ITB 30 using the same patch image data. Further, the charging bias and the development bias are similarly changed for magenta, cyan, and black, to form density patches PM2, PC2, and PK2 on the ITB 30. This processing is repeated five times from n=1 to n=5 for the charging biases VpYn, VpMn, VpCn, and VpKn, and for the development biases VdYn, VdMn, VdCn, and VdKn. Finally, five sets of density patches PYn, PMn, PCn, and PKn (n=1–5) are formed on the ITB 30 in a manner being arranged in the main scanning direction as shown in FIG. 8.

Then, referring again to FIG. 5, in a step S502, the optical sensor 401 is caused to measure the densities of these density patches PYn, PMn, PCn, and PKn (n=1–5). As shown in FIG. 3, the detection of the individual densities is carried out to separately detect densities for diffuse reflection light components detected by the light receiving element Vop and densities for specular reflection light components detected by the light receiving elements Vos. In this connection, the optical sensor 401 is disposed to detects density values at a total of 8 points at sampling time intervals of 15 ms while each density patch on the ITB 30 passes the detection range of the optical sensor 401.

Then, in a step S503, out of the detected density values at 8 points, density values at six points excluding the maximum and minimum values are averaged, and the CPU 202 subjects the average value as the detection result of the optical sensor 401 to analog-to digital conversion by the A/D conversions means 206, and stores the conversion result in the RAM 203 in the image forming apparatus.

Then, in a step S504, the CPU 202 carries out dark current correction in order to eliminate influence of factors other than factors used in the patch density detection from the detection result obtained by the optical sensor 401. This correction is carried out by measuring outputs from the light receiving elements 302 and 303 of the optical sensor 401 while the light emitting element 301 is off, and then subtracting the measured result from the measurement results of density patch, thereby eliminating the influence of factors other than factors used in the patch density detection. The detection results after the dark current correction are written into the RAM 203 as measurement results of diffuse reflection light components Sig.PYn, Sig.PMn, Sig.PCn, and Sig.Pkn, and measurement results of specular reflection light components Sig.SYn, Sig.SMn, Sig.SCn, and Sig.Skn (n=1–5). After the density measurement, the density patches are removed by the cleaner 51.

Then, in a step S505, the CPU 202 calculates the specular reflection components Sig.R from the measurement results of the diffuse reflection light components and the measurement results of the specular reflection light components obtained in the step S504. The equation for the calculation is represented as follows:

$$Sig.R=Sig.P-k\times Sig.S$$

where k represents a detection coefficient for the specular reflection components. The coefficient k varies depending on the characteristics and installation location of the optical sensor 401, and is determined such that Sig.R is 0 when the density patch for each color toner has been measured. In the present embodiment, the coefficient k is set as follows: kY=0.254, kM=0.241, kC=0.23, and kK=0. K=0 implies that the measurement result of the diffuse reflection light components is neglected, and only the measurement result of the specular reflection light components is used for detecting the density of the image patch.

Then, the CPU 202 measures specular reflection components of the ITB 30 alone without a density patch being formed thereon, to obtain the measurement result Sig.RB. Then, the CPU 202 eliminates influence of the surface condition of the base by normalizing the value Sig.R obtained in the step S505 using the measurement result Sig.RB (base correction), to obtain base-corrected specular reflected components Sig.R'. The equation for the normalization is represented as follows:

$$Sig.R'=A\times sig.R/Sig.RB$$

where A represents a constant for the normalization. In the present embodiment, since the image density is controlled in units of ten bits, a hexadecimal value 3FF=1023 is used as the constant A.

Figure 9:
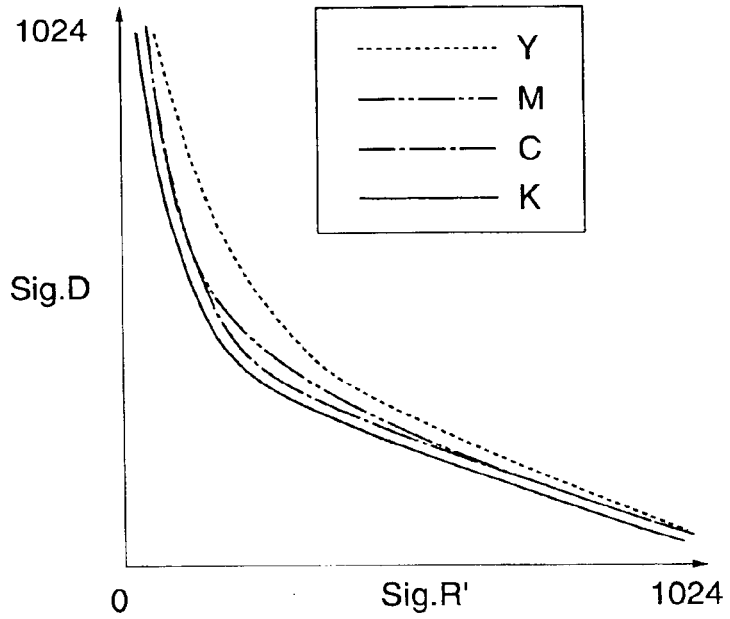
FIG. 9 is a diagram showing a density conversion table.

When the density patch for black is measured, for example, the measurement of diffuse reflection light components results in Sig.PK≈0, and accordingly the value Sir.R' obtained in the step S506 is Sig.R'≈0. Namely, the value of Sig.R' decreases as the density of the density patch increases. Thus, in a step S507, the CPU carries out conversion of Sig.R' such that Sig.R' is proportional to the image density, using a conversion table shown in FIG. 9, thereby obtaining a density value Sig.D as a conversion result.

Figure 10:
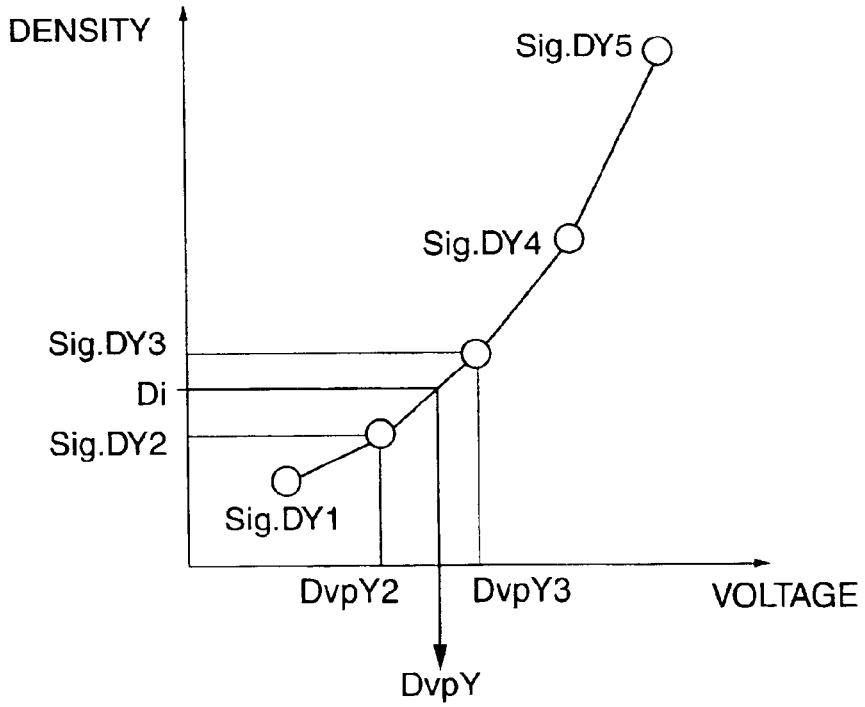
FIG. 10 is a graph showing the relationship between the image density and a target voltage.

Density values Sig.D1 to 5 are thus obtained for each color as described above. When density patches are formed with different image densities in the increasing order of the image density by setting the charging bias Vp and the development bias Vd, density values Sig.DY1 to 5 for yellow are as shown in FIG. 10. A target charging bias Dvp required for obtaining a control target density (Dmax value) Di is obtained by linear interpolation between two points (Sig.DY2, DvpY2) and (Sig.DY3, DvpY3) on the coordinates defined by patch density values Sig.DY2 and Sig.DY3 on the both sides of Di, and corresponding charging bias values DvpY2 and DvpY3. Namely, in the case of yellow, the charging bias DvpY required for obtaining the control target density (Dmax value) Di is obtained using the following equation:

$$DvpY=\{(DvpY3-DvpY2)/(Sig.DY3-Sig.DY2)\}\times(Di-Sig.DY3)+DvpY3$$

Similarly, a target development bias DvdY required for obtaining the control target density (Dmax value) Di for yellow is obtained using the following equation:

$$DvdY=\{(DvdY3-DvdY2)/(Sig.DY3-Sig.DY2)\times(Di-Sig.DY3)+DvdY3$$

Subsequently, the target charging biases and the target development biases for magenta, cyan, and black are calculated by the CPU 202 in a similar manner. The calculated values are written into the RAM for use in subsequent image formation.

In the present embodiment, the reflection quantity Sig.RB of the ITB 30 used in the base correction of the step S506 is measured while an operation of adjusting an image writing position (referred to as "automatic registration correction", hereinafter) is being carried out.

Figure 11:
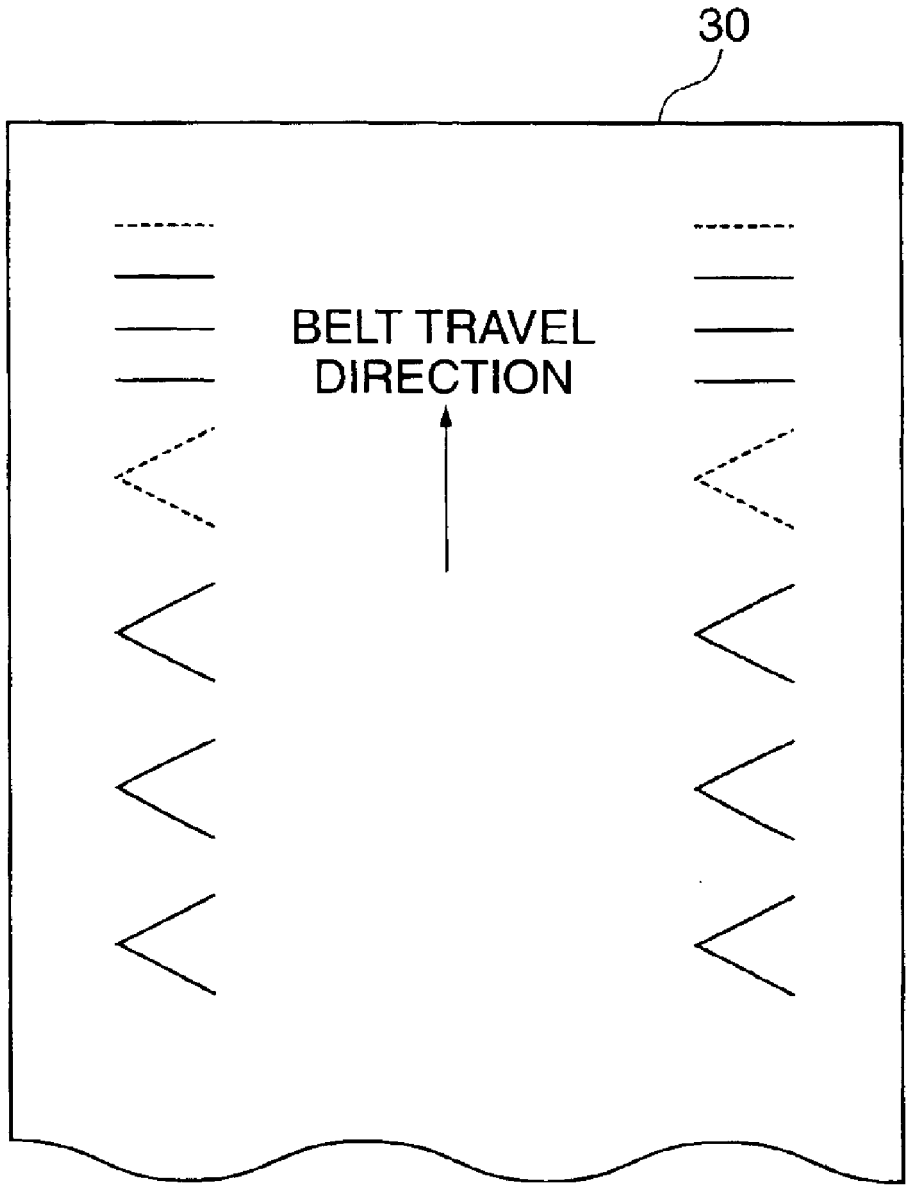
FIG. 11 is a diagram showing an example of toner images to be generated.
Figure 12:
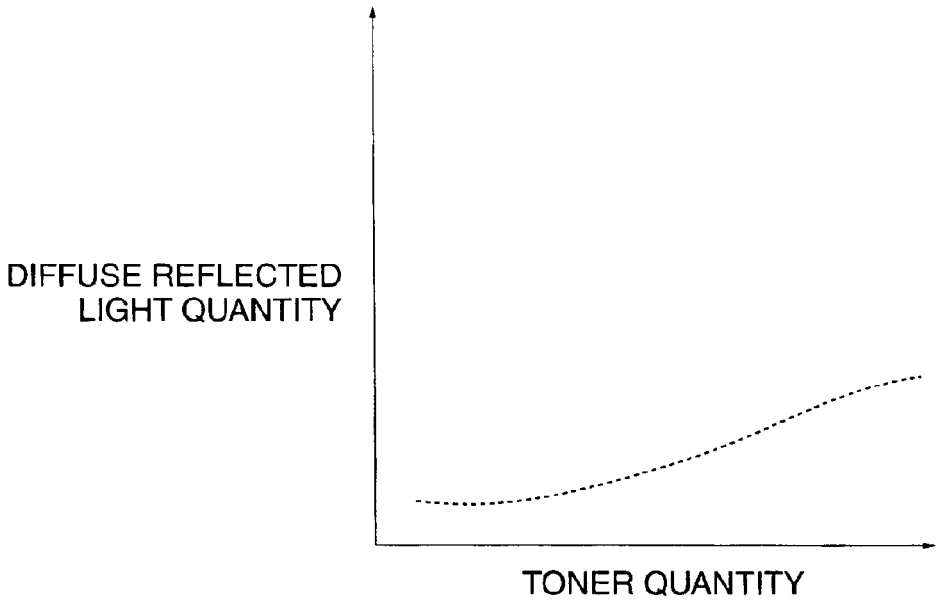
FIG. 12 is a graph showing the relationship between the quantity of an diffuse reflected light and the quantity of a toner in a conventional image forming apparatus.
Figure 13:
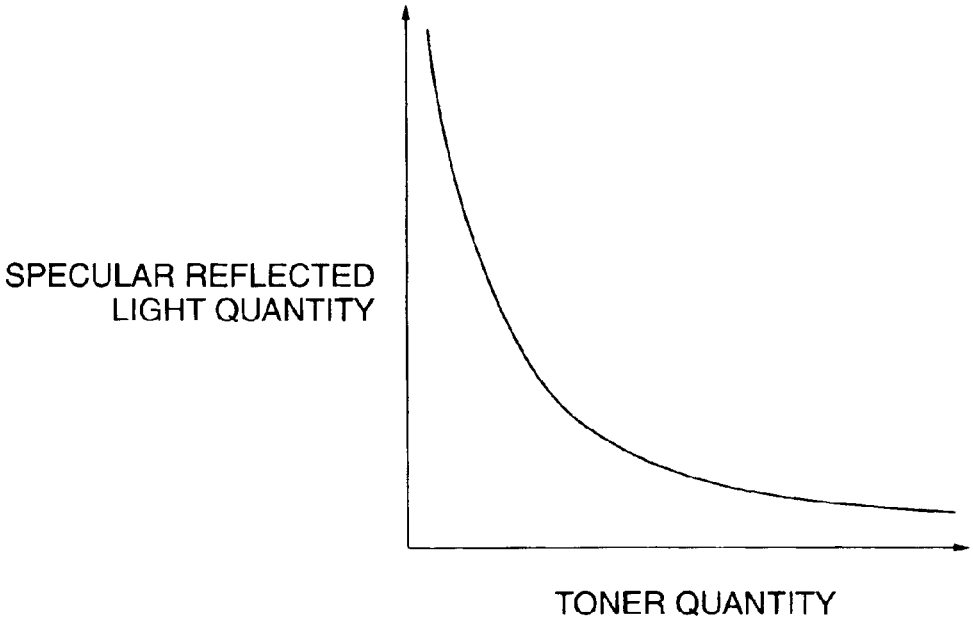
FIG. 13 is a graph showing the relationship between the quantity of specular reflected light and the quantity of a toner.
Figure 14:
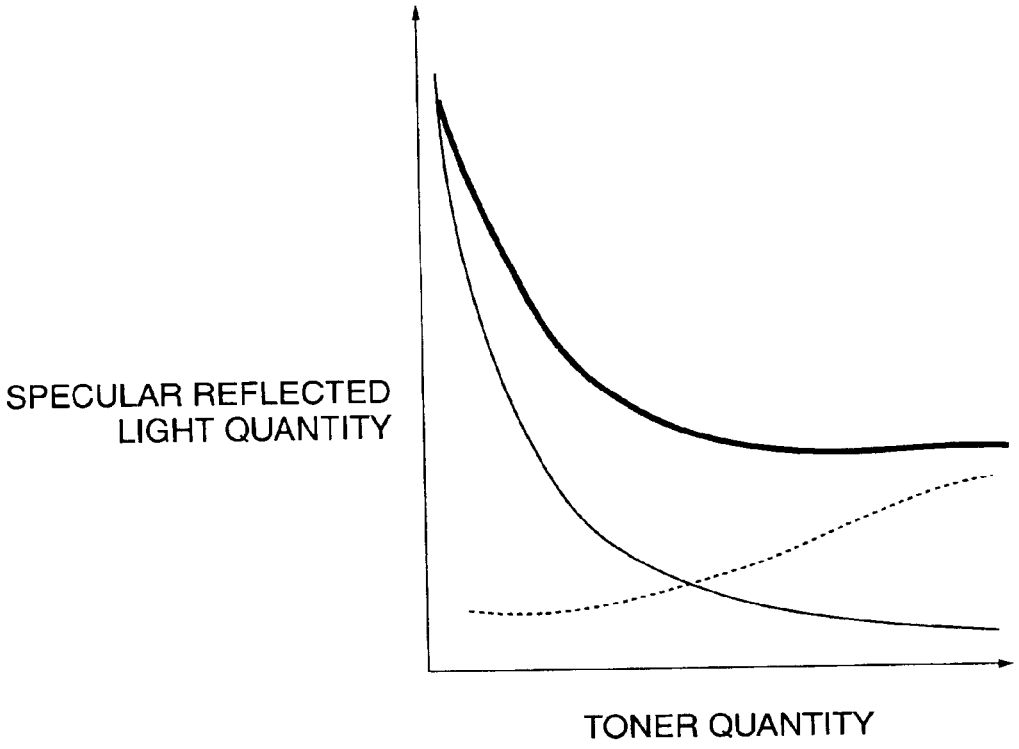
FIG. 14 is a graph showing the relationship between the quantity of a toner and the quantity of reflected light when a density sensor of the type that detects specular reflected light detects a chromatic color toner.
Figure 15:
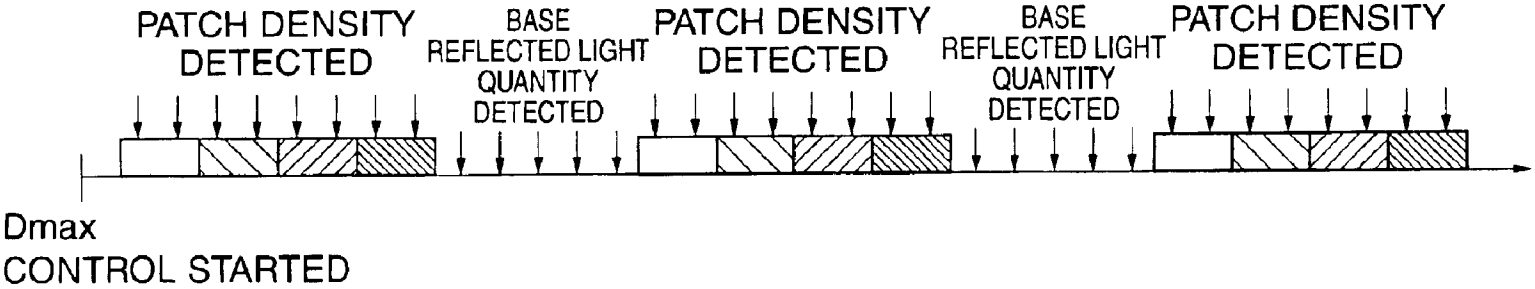
FIG. 15 is a diagram schematically showing a method of alternately measuring the density of the density patches and a base reflected light quantity.
Figure 16:
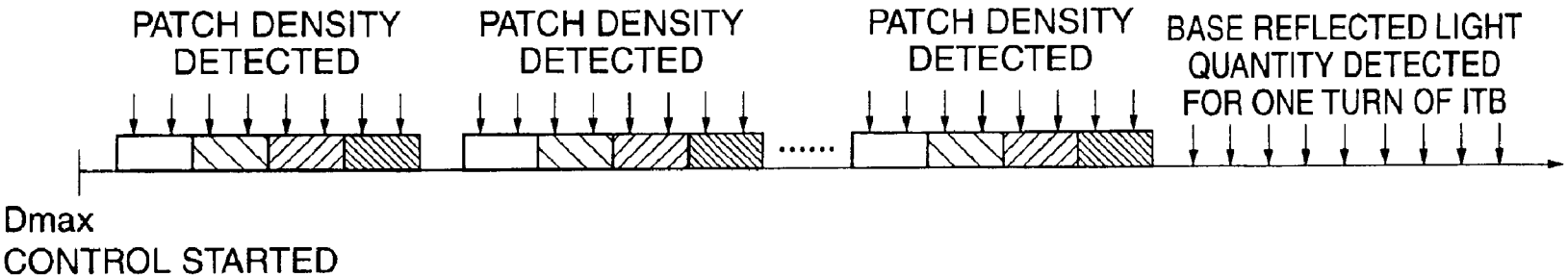
FIG. 16 is a diagram schematically showing a method of successively measuring the densities of the density patches, and then measuring the base reflected light quantity for one turn of an electrostatic (absorption) transfer belt or an intermediate transfer belt.

The automatic registration correction is a process for adjusting variations in image writing timing between the stations for yellow, magenta, cyan, and black as well as inclination of images. In the automatic registration correction, toner images are formed on the both sides of the ITB 30 in the main scanning direction of the ITB 30 as shown in FIG. 11. Correction for variations in image writing timing between the stations is carried out reading the formed toner images using optical sensors 402 and 403 (both optical sensors 402 and 403 are comprised of a light emitting element (a) and a light receiving element (b)) disposed on the both sides of the ITB 30 provided in addition to the optical sensor 401, as shown in FIG. 4. Since the toner images used for the automatic registration correction are formed only on the both sides of the ITB 30, the toner images does not hinder the optical sensor 401 from measuring the reflection quantity of the ITB 30. Thus, the optical sensor 401 is caused to start measuring the reflection quantity of the ITB 30 immediately upon the start of the automatic registration correction process. The optical sensor 401 measures the reflection quantity of the ITB 30 along the ITB 30 for one turn at sampling time intervals of 15 ms, and an average value of the refection quantity for the one turn of the ITB 30 is stored in the RAM 203 as the value Sig.RB.

In the present embodiment, the automatic registration correction is carried out when the power of the image forming apparatus is turned on, and is also carried out once every 300 times of the image formation. Thus, since the reflection quantity Sig.RB of the base of the ITB 30 is periodically updated more frequently than the frequency of execution of the Dmax control, which is once every 500 times of the image formation, the value of the Sig.RB reflects aging change of the ITB 30.

As described above, according to the present embodiment, the reflection quantity Sig.RB of the ITB 30 is measured independently of measurement of the density of the density patches, during the operation of adjusting the image writing position (automatic registration correction), which is carried out when the power of the image forming apparatus is turned on and once every 300 times of the image formation. As a result, it is not necessary to separately determine the reflection quantity of the base of the ITB 30 after measurement of the density of the density patches, to thereby reduce the downtime of the image forming apparatus as much as possible during the Dmax control, and simultaneously carry out optimum image control (especially, image density control). Consequently, with the present invention, it is possible to secure a time for measuring the base reflected light quantity required for the base correction, and at the same time, reduce a time required for the entire image density control.

Next, a second embodiment of the present invention will be described.

The second embodiment of the present invention is different from the above described first embodiment in the timing for measuring the reflection quantity Sig.RB of the ITB 30.

A description will now be given of examples where the CPU 202 measures the reflection quantity Sig.RB of the ITB 30 in any timing while the image forming section 211 is not carrying out the image formation. It should be noted that the second embodiment is identical in the construction of the image forming apparatus and the Dmax control from the first embodiment, and therefor detailed description thereof is omitted.

In the present embodiment, since it takes about seven seconds for the ITB 30 having a peripheral length of 896 mm to rotate by one turn, if a time period can be secured, during which the image formation is not carried out for seven seconds or more (a time period during which the optical sensor 401 is allowed to measure the reflection quantity of the ITB 30), it is possible to measure the reflection quantity Sig.RB of the ITB 30 during the secured time period.

The main controller 205 of the image forming apparatus monitors the status of the image forming apparatus, and starts measuring the reflection quantity Sig.RB when it becomes possible to do so. In the present embodiment, the reflection quantity Sig.RB is measured in any one of measurement timings shown below.

(Measurement Timing 1)

When the temperature of the fixing roller 41*a* is low before the image formation is started, especially when it is expected that it takes seven seconds or more before the temperature of the fixing roller 41*a* reaches a value high enough for carrying out the fixing, the reflection quantity Sig.RB can be measured while the fixing roller 41*a* is heated.

(Measurement Timing 2)

In the case where the image formation is continuously carried out based on data transmitted from a PC or the like, and the time interval between the individual image forming processes is seven seconds or more due to a time period required for transmitting the data or decompressing compressed data, it is possible to measure the reflection quantity Sig.RB in timing between the image forming processes.

(Measurement Timing 3)

When the image formation is carried out on the both surfaces of the recording material P, after an image formation is carried out on the first surface of the recording material P, the recording material P is conveyed through the double-sided sheet roller pairs 74*a* to 74*d*, and then the second image formation is carried out on the second surface of the recording material P when the recording material P passes the secondary transfer roller 36 again as described with reference to the first embodiment.

To carry out the image formation on the both surfaces of the recording material P with a certain productivity, it is desirable to alternately carry out the operation of forming an image on the first surface of the recording material P conveyed from any one of the sheet feed cassettes 21*a* to 21*d* and the operation of forming an image on the second surface of the recording material P having been conveyed through the double-sided sheet roller pairs 74*a* to 74*d*. However, when the recording material P is changed to a different size one in the course of the successive image forming processes, it is difficult to alternately form an image on the recording material P conveyed from any one of the sheet feed cassettes 21*a* to 21*d* and on the recording material P having been conveyed through the double-sided sheet roller pairs 74*a* to 74*d*. Thus, when the recording material P is changed to a different size one in the course of the successive image forming processes, it is necessary to start the image formation on the recording material P of a next size after the entire image formation on the both surfaces of the material P of a first size is completed. In this case, the time interval between the image forming processes is longer than in the case where the image formation on the first surface and the image formation on the second surface are alternately carried out, it is possible to measure the reflection quantity Sig.RB during this time interval.

(Measurement Timing 4)

In the image forming apparatus according to the present embodiment, the rotational speed of the photosensitive drums 11*a* to 11*d* and the conveying speed of the ITB and/or the electrostatic (absorption) transfer belt (ETB) are changed according to the type of the recording material P to obtain an optimal fixing time period for any type of the recording material P. Therefore, when the type of the recording material P is changed in the course of successive image formation processes, it is necessary to switch the speed of the image forming apparatus after all the recording materials P of a first type on which image formation has already been carried out are discharged from the image forming apparatus, and then to start the image formation on the recording material P of a next type. In this case, since the image formation cannot be carried out during the switching of the speed of the image forming apparatus, if the switching time period is seven seconds or more, the reflection quantity Sig.RB can be measured during this switching time period.

(Measurement Timing 5)

In the present embodiment, in principle, voltage is applied to the photosensitive drums 11*a* to 11*d* when the image formation is carried out in the four colors, and voltage is applied only to the photosensitive drum 11*a* when the image formation is carried out in a single color of black. Thus, when the image formation in the single black color is carried out following the image formation for a four-color image, or, conversely, when the image formation for a four-color image is carried out following the image formation in the single black color, it is necessary to stop the application of voltage to the photosensitive drum(s) which is not necessary for the next image formation, and then apply voltage to the photosensitive drum(s) required for the next image formation. When application of voltage to the photosensitive drum(s) and stop thereof are thus switched in the course of the image formation, if the switching takes seven seconds or more, the reflection quantity Sig.RB can be measured during the switching time period.

(Measurement Timing 6)

In the case where the temperature inside the image forming apparatus is high after completion of the image formation, the temperature inside the image forming apparatus will rise excessively high if the image formation is continued, and therefore it is necessary to rotate a cooling fan for cooling the inside of the image forming apparatus for a certain time period. Thus, when it is expected that it takes seven seconds or more before the temperature inside the image forming apparatus falls low enough for the image formation, the reflection quantity Sig.RB can be measured while the cooling fan is being operated.

(Measurement Timing 7)

When a post processing device such as a finisher or a sorter is connected to a discharging section of the image forming apparatus, the post processing device carry out post processes such as stitching, punching, and book binding on the recording material P after the image formation. In this case, if it is expected that the process by the post processing device takes seven seconds or more, the reflection quantity Sig.RB can be measured on the image forming apparatus side in parallel with the operation of the post processing device.

The reflection quantity Sig.RB can be measured in any one of the timings described above. Measurement of the reflection quantity Sig.RB is carried out in a similar manner to that of the first embodiment, specifically, the optical sensor 401 is caused to measure the reflection quantity of the ITB 30 for one turn of the ITB 30 at sampling time intervals of 15 ms, and an average value of the measured reflection quantity values for the one turn of the ITB 30 is stored as the reflection quantity Sig.RB in the RAM 203. When the reflection quantity Sig.RB obtained in this way is used during the Dmax control, which makes it unnecessary to separately determine the reflection quantity of the base of the ITB 30, whereby it is possible to reduce the downtime of the image forming apparatus during execution of the Dmax control.

As described above, according to the present embodiment, although the reflection quantity Sig.RB of the ITB 30 is measured in different timing from that in the first embodiment, it is not necessary to separately determine the reflection quantity of the base of the ITB 30 following measurement of the density of density patches, which makes it possible to reduce the downtime of the image forming apparatus as much as possible during execution of the Dmax control, and at the same time, carry out optimum image control (especially image density control). As a result, according to the present embodiment, it is possible to secure a time for measuring the base reflected light quantity required for the base correction, and at the same time, reduce a time required for the entire image density control.

Although in the first and second embodiments described above, the Dmax control is carried out as means for adjusting the image forming conditions of the image forming apparatus, the present invention may be applied to the Dhalf control which is image density control that maintains the gradation characteristics of a halftone linear with respect to the image signal, in such a manner that the base correction is carried out based on the measurement result of density patches formed on the ITB or the ETB whereby it is also possible to reduce the downtime of the image forming apparatus using the reflection quantity of the base measured in a different image adjusting process, as in the first and second embodiments.

It goes without saying that the object of the present invention may also be accomplished by supplying a system or an apparatus with a storage medium (or a recording medium) in which a program code of software, which realizes the functions of either of the above described first and second embodiments is stored, and causing a computer (or CPU or MPU) of the system or apparatus to read out and execute the program code stored in the storage medium.

In this case, the program code itself read from the storage medium realizes the functions of either of the above described embodiments, and hence the program code and a storage medium on which the program code is stored constitute the present invention.

Further, it is to be understood that the functions of either of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of either of the above described embodiments may be accomplished by writing the program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

Further, the above program has only to realize the functions of either of the above-mentioned embodiments on a computer, and the form of the program may be an object code, a program executed by an interpreter, or script data supplied to an OS.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program is supplied by downloading from another computer, a database, or the like, not shown, connected to the Internet, a commercial network, a local area network, or the like.

What is claimed is:

1. An image forming apparatus comprising:

an image forming unit including an image carrier disposed to be exposed to light to have a latent image formed thereon, an electrostatic charger that charges said image carrier to a predetermined polarity, a developing device that visualizes the latent image formed on said image carrier to form a visible image, and an endless belt onto which the visible image is transferred;

a plurality of image adjusting devices that adjust image forming conditions of said image forming unit, said image adjusting devices including a first image adjusting device and a second image adjusting device;

a detection pattern forming device that controls said image forming unit to form predetermined detection patterns on said endless belt;

a detecting device that detects the detection patterns formed on said endless belt and a quantity of reflection light from said endless belt itself; and a correction device that corrects the detection patterns detected by said detecting device based on the quantity of reflection light from said endless belt itself detected by said detecting device;

wherein:

said first image adjusting device adjusts one of the image forming conditions of said image forming unit based on the corrected detection result of the detection patterns;

said second image adjusting device adjusts another one of the image forming conditions of said image forming unit; and said detecting device detects the quantity of reflection light from said endless belt itself in timing synchronous with the adjustment of the other one of the image forming conditions by said second image adjusting device, other than at which the one of the image forming conditions is adjusted by said first image adjusting device.

2. An image forming apparatus according to claim 1, wherein said detecting device detects density patches formed on said endless belt as the predetermined detection patterns, and said first image adjusting device adjusts the one of the image forming conditions of said image forming unit based on the detected density patches, to adjust density of an image to be formed.

3. An image forming apparatus according to claim 2, wherein said first image adjusting device carries out one of image density control that maintains respective maximum densities of a plurality of predetermined colors constant and image density control that maintains gradation characteristics of halftone linear with respect to an image signal obtained by reading an image on an original.

4. An image forming apparatus according to claim 1, wherein said second image adjusting device comprises a device that rotates said endless belt, and a device that forms images on said endless belt at locations other than locations at which the predetermined detection patterns are formed.

5. An image forming apparatus according to claim 2, wherein said second image adjusting device comprises an image writing position adjusting device that adjusts a wilting position for an image.

6. An image forming apparatus comprising:

an image forming unit including an image carrier disposed to be exposed to light to have a latent image formed thereon, an electrostatic charger that charges said image carrier to a predetermined polarity, a developing device that visualizes the latent image formed on said image carrier to form a visible image, and an endless belt onto which the visible image is transferred;

a detection pattern forming device that controls said image forming unit to form predetermined detection patterns on said endless belt;

a detecting device that defeats the detection patterns formed on said endless belt and a quantity of reflection light from said endless belt itself;

a correction device that corrects the detection patterns detected by said detecting device based on the quantity of reflection light from said endless belt itself detected by said detecting device; and an image adjusting device that adjusts at least one image forming condition of said image forming unit based on the corrected detection result of the detection patterns;

wherein said detecting device detects the quantity of reflection light from said endless belt itself in timing earlier than at which the at least one image forming condition is adjusted by said image adjusting device.

7. An image forming apparatus according to claim 6, wherein said detecting device detects density patches formed on said endless belt as the predetermined detection patterns, and said image adjusting device adjusts the at least one image forming condition of said image forming unit based an the detected density patches, to adjust density of an image to be formed.

8. An image forming apparatus according to claim 7, wherein said image adjusting device carries out one of image density control that maintains respective maximum densities of a plurality of predetermined colors constant and image density control that maintains gradation characteristics of halftone linear with respect to an image signal obtained by reading an image on an original.

9. An image forming apparatus according to claim 6, wherein the timing earlier than at which the at least one image forming condition is adjusted is at which said endless belt is rotating and at a same time images are formed on said endless bell at locations other than locations at which the predetermined detection patterns are formed.

10. An image forming apparatus according to claim 1 or 6, wherein said endless belt is an intermediate transfer belt.

11. A storage device storing a computer program for controlling an image forming apparatus including an image forming unit including an image carrier disposed to be exposed to light to have a latent image formed thereon, an electrostatic charger that charges said image canter to a predetermined polarity, a developing device that visualizes the latent image formed on said image carrier to form a visible image, and an endless belt onto which the visible image is transferred, the program comprising:

a plurality of image adjusting modules for adjusting image forming conditions of said image forming unit, said image adjusting modules including a first image adjusting module and a second image adjusting module;

a detection pattern forming module for controlling said image forming unit to form predetermined detection patterns on said endless belt;

a first detecting module for detecting the detection patterns formed on said endless belt;

a second detecting module for detecting a quantity of reflection light from said endless belt itself; and a correction module for correcting the detection patterns detected by said first detecting module based on the quantity of reflection light from said endless belt itself detected by said second detecting module;

wherein:

said first image adjusting module adjusts one of the image forming conditions of said image forming unit based on the corrected detection result of the detection patterns;

said second image adjusting module adjusts another one of the image forming conditions of said image forming unit; and said second detecting module detects the quantity of reflection light from said endless belt itself timing synchronous with the adjustment of the other one of the image forming conditions by said second image adjusting module, other than at which the one of the image forming conditions is adjusted by said first image adjusting module.

12. A storage device storing a computer program for controlling an image forming apparatus including an image forming unit including an image canter disposed to be exposed to light to have a latent image formed thereon, an electrostatic charger that charges said image carrier to a predetermined polarity, a developing device that visualizes the latent image formed on said image carrier to form a visible image, and an endless belt onto which the visible image is transferred, the program comprising:

a detection pattern forming module for controlling said image forming unit to form predetermined detection patterns on said endless belt;

a first detecting module for detecting the detection patterns formed on said endless belt;

second detecting module for detecting a quantity of reflection light from said endless belt itself;

a correction module for correcting the detection patterns detected by said first detecting module based on the quantity of reflection light from said endless belt itself detected by said second detecting module; and an image adjusting module for adjusting at least one image forming condition of said image forming unit based on the corrected detection result of the detection patterns;

wherein said second detecting module detects the quantity of reflection light from said endless belt itself in timing earlier than at which the at least one image forming condition is adjusted by said image adjusting module.

13. An image forming apparatus comprising:

an image forming unit including an image carrier disposed to be exposed to light to have a latent image formed thereon, an electrostatic charger that charges said image carrier to a predetermined polarity, a developing device that visualizes the latent image formed on said image carrier to form a visible image, and an endless belt onto which the visible image is transferred;

a detection pattern forming device that controls said image forming unit to form predetermined detection patterns on said endless belt;

a detecting device that detects the detection patterns formed on said endless belt and a quantity of reflection light from said endless belt;

a correction device that corrects the detection patterns detected by said detecting device based on the quantity of reflection light from said endless belt detected by said detecting device; and an image adjusting device that adjusts at least one image forming condition of said image forming unit based on the corrected detection result of the detection patterns;

wherein:

said image adjusting device includes an image writing position adjusting device that adjusts a writing position for an image; and said detecting device detects the quantity of reflection light from said endless belt in timing different from at which the at least one image forming condition is adjusted by said image adjusting device, by detecting the quantity of reflection light upon turning-on of power of the image forming apparatus or in synchronism with the adjustment of the writing position for an image.

14. An image forming apparatus comprising:

an image forming unit including an image carrier disposed to be exposed to light to have a latent image formed thereon, an electrostatic charger that charges said image carrier to a predetermined polarity, a developing device that visualizes the latent image formed on said image carrier to form a visible image, and an endless belt onto which the visible image is transferred;

a detection pattern farming device that controls said image forming unit to form predetermined detection patterns on said endless belt;

a first detecting device that detects the detection patterns formed on said endless belt and a quantity of reflection light from said endless belt itself;

a second detecting device that is disposed at a location different from a location at which said first detecting device is disposed and detects the detection patterns formed on said endless belt;

a correction device that corrects the detection patterns detected by said first detecting device based on the quantity of reflection light from said endless belt itself detected by said first detecting device; and an image adjusting device that adjusts at least one image forming condition of said image forming unit based on the corrected detection result of the detection patterns;

wherein said first detecting device detects the quantity of reflection light from said endless belt itself in timing at which the detection patterns are detected by said second detecting device, other than at which the at least one image forming conditions is adjusted by said image adjusting device.

15. An image forming apparatus comprising:

an image forming unit including an image carrier disposed to be exposed to light to have a latent image formed thereon, an electrostatic charger that charges said image carrier to a predetermined polarity, a developing device that visualizes the latent image formed on said image carrier to form a visible image, and an endless belt onto which the visible image is transferred;

a plurality of image adjusting devices that adjust image forming conditions of said image forming unit, said image adjusting devices including a first image adjusting device and a second image adjusting device;

a detection pattern forming device that controls said image forming unit to form predetermined detection patterns on said endless belt;

a detecting device that detects the detection patterns formed on said endless belt and a quantity of reflection light from said endless belt; and a correction device that corrects the detection patterns detected by said detecting device based on the quantity of reflection light from said endless belt detected by said detecting device;

wherein:

said first image adjusting device adjusts one of the image forming conditions of said image forming unit based on the corrected detection result of the detection patterns;

said second image adjusting device adjusts another one of the image forming conditions of said image forming unit, and comprises a device that rotates said endless belt and a device that forms images on said endless belt at locations other than locations at which the predetermined detection patterns are formed; and said detecting device detects the quantity of reflection light from said endless belt in timing synchronous with the adjustment of the other one of the image forming conditions by said second image adjusting device.

16. An image forming apparatus comprising:

an image forming unit including an image carrier disposed to be exposed to light to have a latent image formed thereon, an electrostatic charger that charges said image carrier to a predetermined polarity, a developing device that visualizes the latent image formed on said image canter to form a visible image, and an endless belt onto which the visible image is transferred;

a plurality of image adjusting devices that adjust image forming conditions of said image forming unit, said image adjusting devices including a first image adjusting device and a second image adjusting device;

a detection pattern forming device that controls said image forming unit to form predetermined detection patterns on said endless belt;

a detecting device that detects the detection patterns formed on said endless belt and a quantity of reflection light from said endless belt, and density patches formed on said endless belt as the predetermined detection patterns; and a correction device that corrects the detection patterns detected by said detecting device based on the quantity of reflection light from said endless belt detected by said detecting device;

wherein:

said first image adjusting device adjusts one of the image forming conditions of said image forming unit based on the corrected detection result of the detection patterns, and adjusts the one of the image forming conditions of said image forming unit based on the detected density patches, to adjust density of an image to be formed;

said second image adjusting device adjusts another one of the image forming conditions of said image forming unit and comprises an image writing position adjusting device that adjusts a writing position for an image; and said detecting device detects the quantity of reflection light from said endless belt in timing synchronous with the adjustment of the other one of the image forming conditions by said second image adjusting device.

* * * * *